US009247815B2

(12) United States Patent
Chen et al.

(10) Patent No.: US 9,247,815 B2
(45) Date of Patent: Feb. 2, 2016

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/217,685

(22) Filed: Mar. 18, 2014

(65) Prior Publication Data

US 2015/0270665 A1 Sep. 24, 2015

(51) Int. Cl.
*H01R 25/16* (2006.01)
*A47B 88/16* (2006.01)

(52) U.S. Cl.
CPC ..... *A47B 88/16* (2013.01); *A47B 2210/007* (2013.01); *A47B 2210/0016* (2013.01); *A47B 2210/0064* (2013.01); *H01R 25/16* (2013.01)

(58) Field of Classification Search
CPC ..... A47B 88/04; A47B 88/16; A47B 2210/0016; A47B 2210/0018; A47B 2210/0064; A47B 2210/0067; A47B 2210/007; A47B 2210/0081
See application file for complete search history.

(56) References Cited

U.S. PATENT DOCUMENTS

| | | | | |
|---|---|---|---|---|
| 4,469,384 | A * | 9/1984 | Fler et al. | 312/333 |
| 4,537,450 | A * | 8/1985 | Baxter | 384/18 |
| 5,181,782 | A * | 1/1993 | Wojcik | 384/21 |
| 6,126,255 | A * | 10/2000 | Yang | 312/334.46 |
| 6,244,678 | B1 * | 6/2001 | Dopp et al. | 312/333 |
| 6,379,045 | B1 * | 4/2002 | Cirocco | 384/18 |
| 6,402,275 | B1 * | 6/2002 | Yang | 312/334.46 |
| 6,997,529 | B1 | 2/2006 | Chen et al. | |
| 7,240,977 | B2 * | 7/2007 | He | 312/333 |
| 7,413,269 | B2 | 8/2008 | Chen et al. | |
| 7,611,213 | B2 * | 11/2009 | Wu et al. | 312/334.44 |
| 8,152,250 | B2 | 4/2012 | Aguilar et al. | |
| 2003/0209959 | A1 * | 11/2003 | Shih-Long et al. | 312/334.46 |
| 2004/0174103 | A1 * | 9/2004 | Yang | 312/334.46 |

OTHER PUBLICATIONS

CA1125346A1 bibliographic data.pdf, 1 page.*

* cited by examiner

*Primary Examiner* — Andrew Roersma
(74) *Attorney, Agent, or Firm* — Rosenberg, Klein & Lee

(57) ABSTRACT

A slide rail assembly includes first, second, and third rails slidably connected together, a guiding base on the first rail, a first contact member on the second rail, and a second contact member on the third rail. The first contact member extends through an opening of the second rail and corresponds to the guiding base. When the third rail is pulled out, the second contact member, which corresponds to the first contact member, abuts against the first contact member such that the second rail is displaced with the third rail. Once the first contact member is guided by the guiding base to another position and separates from the second contact member, the third rail can be pulled out relative to the second rail.

5 Claims, 11 Drawing Sheets

SLIDE RAIL ASSEMBLY

FIELD OF THE INVENTION

The present invention relates to a slide rail assembly and more particularly to a slide rail assembly having two slide rails which are simultaneously displaceable.

BACKGROUND OF THE INVENTION

U.S. Pat. Nos. 6,997,529 B1 and 7,413,269 B2, both granted to Chen et al. disclose a slide rail assembly featuring simultaneous displacement of two slide rails and are referenced when the present invention was made. As two simultaneously displaceable slide rails provide better support, a slide rail assembly having such slide rails can withstand a higher load and is therefore well received on the market. The present invention aims to provide an improved version of such a slide rail assembly.

SUMMARY OF THE INVENTION

The present invention relates to a slide rail assembly having two slide rails which can be displaced simultaneously.

According to one aspect of the present invention, a slide rail assembly includes a first rail; a second rail slidably connected to the first rail, the second rail having an opening; a third rail slidably connected to the second rail; a guiding base provided on the first rail, the guiding base having a pair of guiding portions and a stop portion, the guiding portions defining a guiding path and a guiding entrance in communication with the guiding path; a first contact member provided on the second rail, the first contact member including a pair of first contact portions and a pair of second contact portions connected to the first contact portions, wherein the second contact portions extend through the opening of the second rail and correspond to the guiding entrance of the guiding base; and a second contact member provided on the third rail, the second contact member having at least one lateral portion corresponding to one of the first contact portions of the first contact member. The guiding path of the guiding base has a first width, the guiding entrance of the guiding base has a second width, and the second contact portions of the first contact member define a third width therebetween, wherein the third width is greater than the first width but less than the second width. When the third rail is pulled out from a retracted position relative to the second rail, the lateral portion of the second contact member is pressed against the corresponding one of the first contact portions of the first contact member such that the second rail is displaced simultaneously with the third rail by means of the first contact member. Once the second rail is displaced to a predetermined position relative to the first rail, the first contact member abuts against the guiding base, and the second contact portions of the first contact member are guided by the guiding path of the guiding base. Consequently, with the first contact portions of the first contact member displaced toward each other, the lateral portion of the second contact member separates from the corresponding one of the first contact portions of the first contact member, allowing the third rail to be pulled out and displaced relative to the second rail.

Preferably, the slide rail assembly further includes a fixing base fixed to the first rail. The fixing base has a pair of arms which define a clamping space therebetween, and the second contact member has a projection corresponding to the clamping space. When in the retracted position, the projection of the second contact member extends into the clamping space and is clamped by the arms of the fixing base.

Preferably, the second contact member has a pair of the aforesaid lateral portions which correspond respectively to the first contact portions of the first contact member.

Preferably, the lateral portions of the second contact member have inner surfaces facing each other and defining a fourth width therebetween, and the first contact portions of the first contact member have outer surfaces facing away from each other and defining a fifth width therebetween, wherein the fifth width is slightly greater than the fourth width.

Preferably, the first contact portions of the first contact member form a V shape.

BRIEF DESCRIPTION OF THE DRAWINGS

The invention as well as a preferred mode of use and the advantages thereof will be best understood by referring to the following detailed description of some illustrative embodiments in conjunction with the accompanying drawings, wherein.

DETAILED DESCRIPTION OF THE INVENTION

Figure 1:
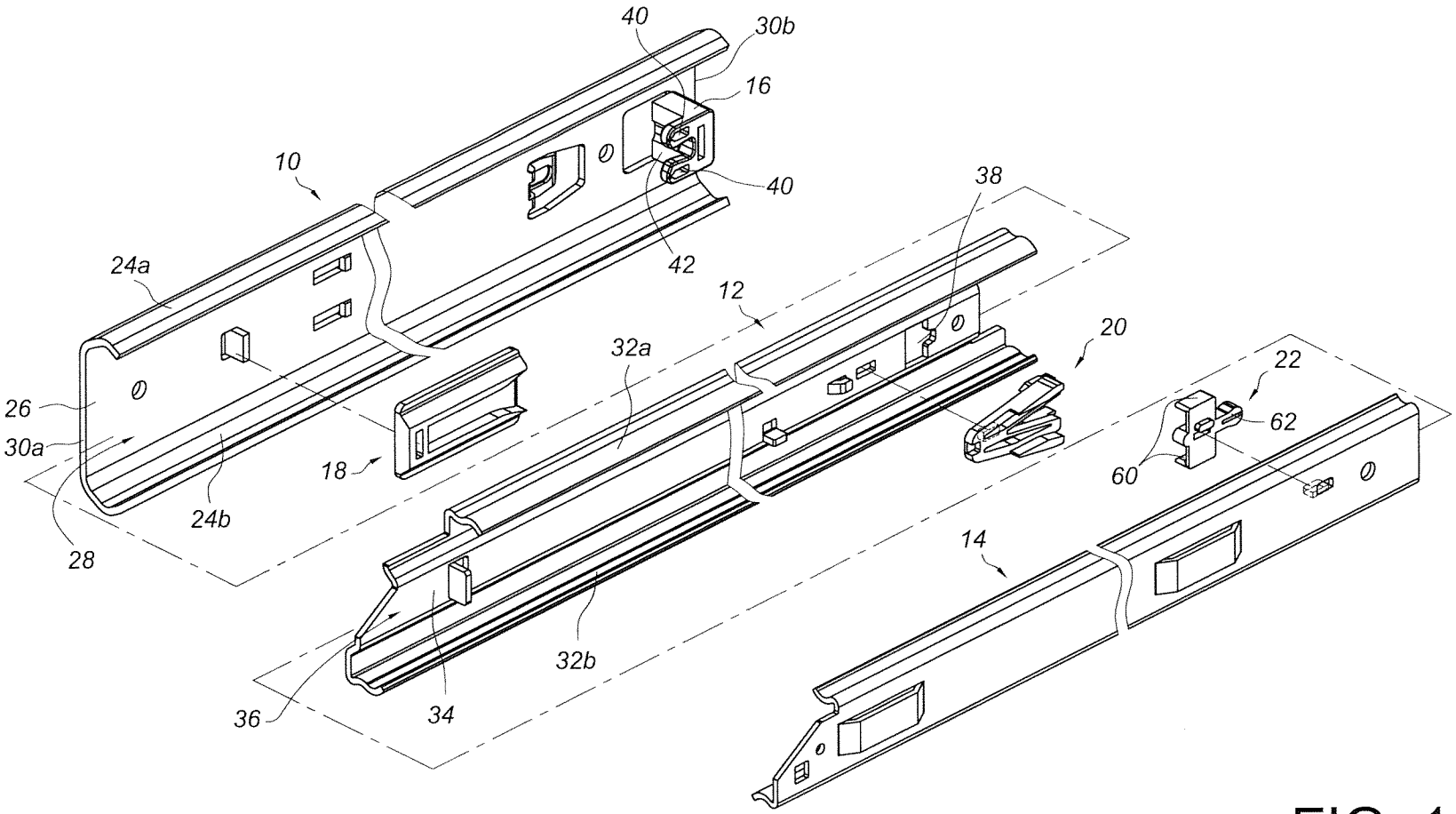
FIG. 1 is an exploded perspective view of the slide rail assembly in one embodiment of the present invention.

FIG. 1 shows the slide rail assembly in one embodiment of the present invention. The slide rail assembly includes a first rail 10, a second rail 12, a third rail 14, a fixing base 16, a guiding base 18, a first contact member 20, and a second contact member 22.

The first rail 10 includes an upper wall 24*a*, a lower wall 24*b*, and a sidewall 26 extending between the upper wall 24*a* and the lower wall 24*b*. The upper wall 24*a*, the lower wall 24*b*, and the sidewall 26 of the first rail 10 jointly define a first channel 28. The sidewall 26 has a front end 30*a* and a rear end 30*b*.

The second rail 12 is slidably connected to the first rail 10. The second rail 12 also includes an upper wall 32*a*, a lower wall 32*b*, and a sidewall 34 extending between the upper wall 32*a* and the lower wall 32*b*. The upper wall 32*a*, the lower wall 32*b*, and the sidewall 34 of the second rail 12 jointly define a second channel 36. The sidewall 34 has an opening 38.

The third rail 14 is slidably connected to the second rail 12.

The fixing base 16 is fixedly mounted on the first rail 10 and is adjacent to the rear end 30*b* of the first rail 10. The fixing base 16 is located in the first channel 28 of the first rail 10. The fixing base 16 includes a pair of arms 40. The arms 40 define a clamping space 42 therebetween.

Figure 2:
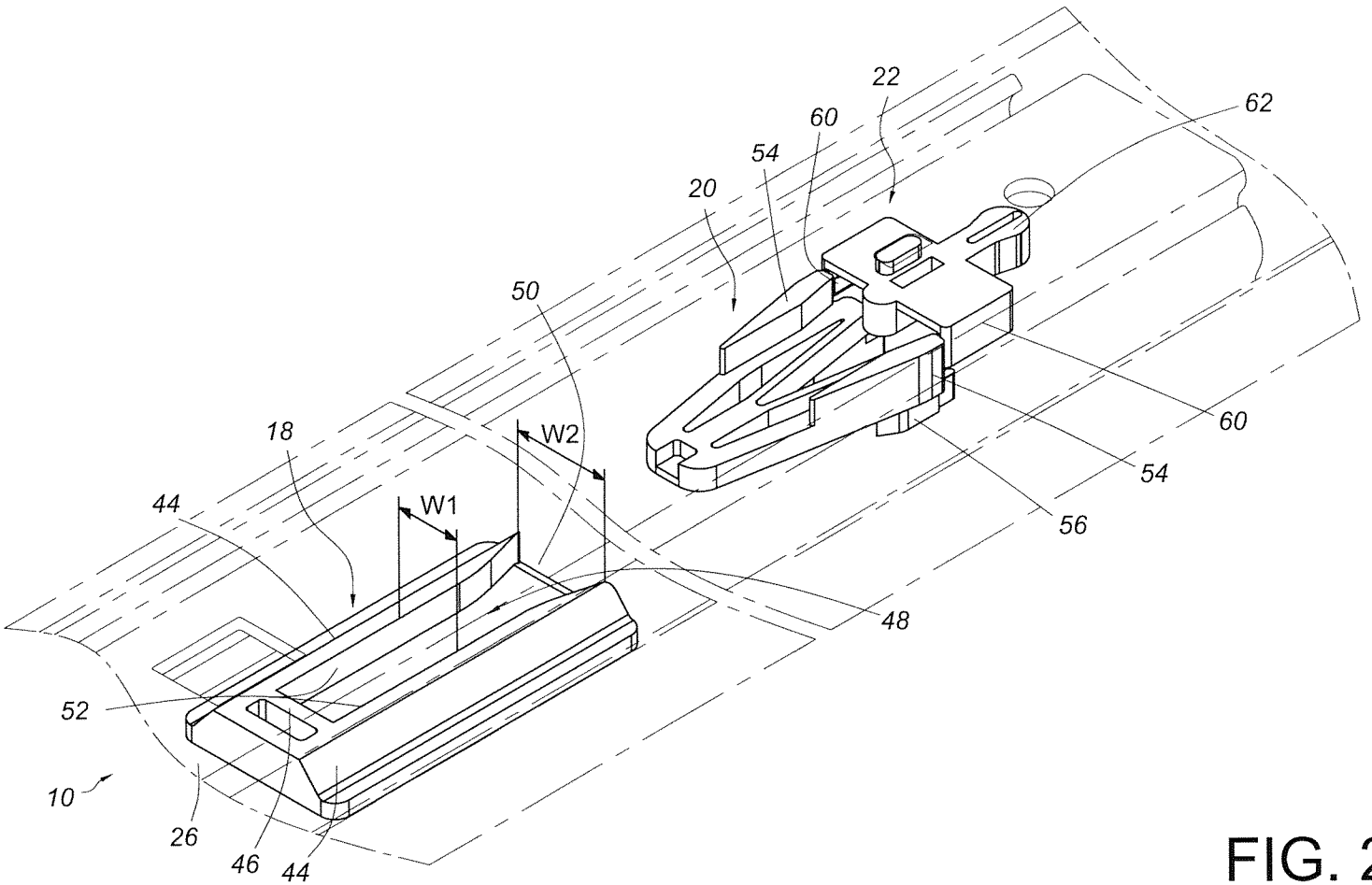
FIG. 2 is a perspective view showing the arrangement of certain components in one embodiment of the present invention.

The guiding base 18 is provided on the sidewall 26 of the first rail 10 and is located in the first channel 28 of the first rail 10. As shown in FIG. 2, the guiding base 18 has a pair of longitudinal guiding portions 44 and a stop portion 46. The longitudinal guiding portions 44 define a guiding path 48 and a guiding entrance 50 in communication with the guiding path 48. Each of the longitudinal guiding portions 44 has a surface 52 which is located in the guiding path 48 and the guiding entrance 50. More specifically, the surfaces 52 of the longitudinal guiding portions 44 that are located in the guiding path 48 define a first width W1 therebetween, and the surfaces 52 of the longitudinal guiding portions 44 that are located at the guiding entrance 50 define a second width W2 therebetween.

Figure 3:
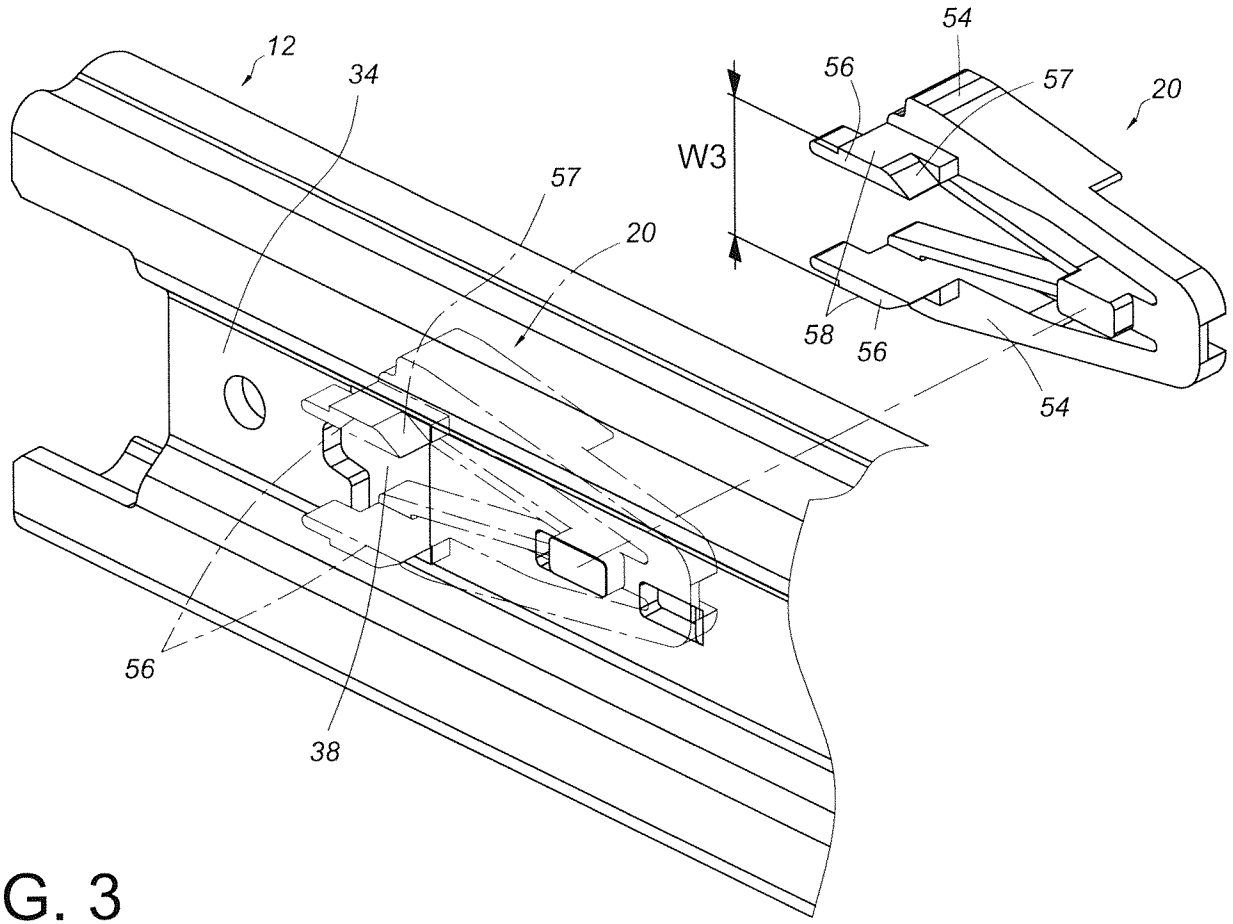
FIG. 3 is a perspective view showing how the first contact member in one embodiment of the present invention is disposed.

As shown in FIG. 3, the first contact member 20 is provided on the sidewall 34 of the second rail 12. The first contact member 20 includes a pair of first contact portions 54 and a pair of second contact portions 56 which are connected to the first contact portions 54. The second contact portions 56 extend through the opening 38 of the second rail 12. Referring back to FIG. 2, the second contact portions 56 correspond to the guiding entrance 50 of the guiding base 18. In one preferred embodiment, the first contact portions 54 form a V shape, the second contact portions 56 have surfaces 58 which face away from each other, and the surfaces 58 define a third width W3 therebetween, wherein the third width W3 is greater than the first width W1 of the guiding path 48 of the guiding base 18 but less than the second width W2 at the guiding entrance 50 of the guiding base 18. Preferably, each of the second contact portions 56 has an inclined surface 57 corresponding to the guiding entrance 50 of the guiding base 18 so that the guiding base 18 can guide the second contact portions 56 with ease.

As shown in FIG. 1, the second contact member 22 is provided on the third rail 14.

Figure 4:
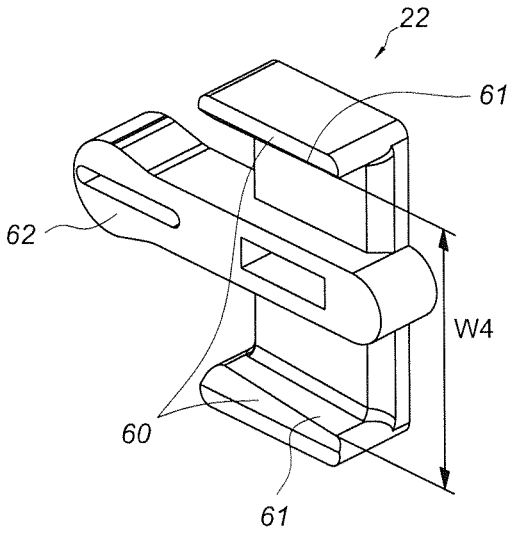
FIG. 4 is a perspective view of the second contact member in one embodiment of the present invention.
Figure 5:
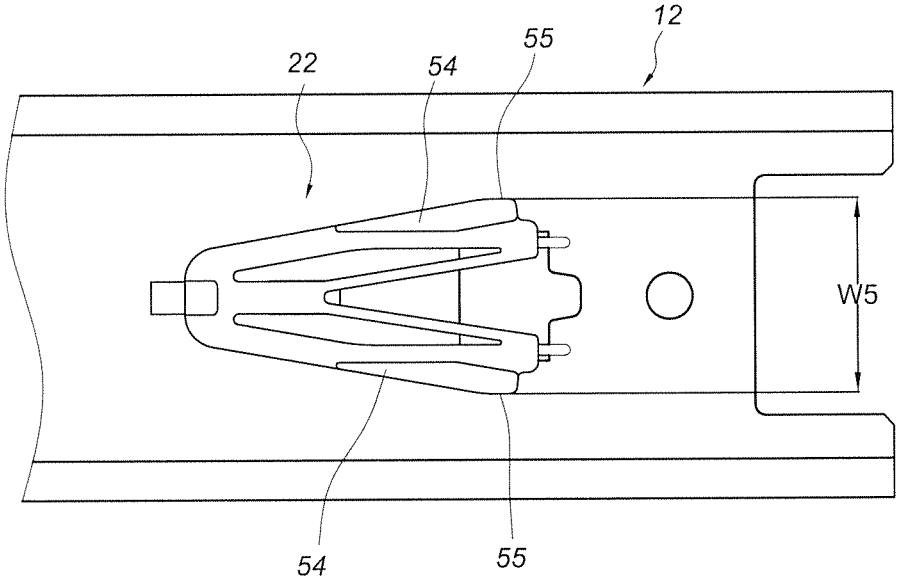
FIG. 5 is a schematic plan view showing how the first contact member in one embodiment of the present invention is installed on the second rail.

The second contact member 22 includes a pair of lateral portions 60 and a projection 62. The lateral portions 60 correspond to the first contact portions 54 of the first contact member 20 respectively while the projection 62 corresponds to the clamping space 42 of the fixing base 16. Preferably, as shown in FIG. 4, the lateral portions 60 have inner surfaces 61 which face each other, and the inner surfaces 61 define a fourth width W4 therebetween. Also preferably, as shown in FIG. 5, the first contact portions 54 of the first contact member 20 have outer surfaces 55 which face away from each other, and the outer surfaces 55 define a fifth width W5 therebetween, wherein the fifth width W5 is slightly greater than the fourth width W4.

Figure 6:
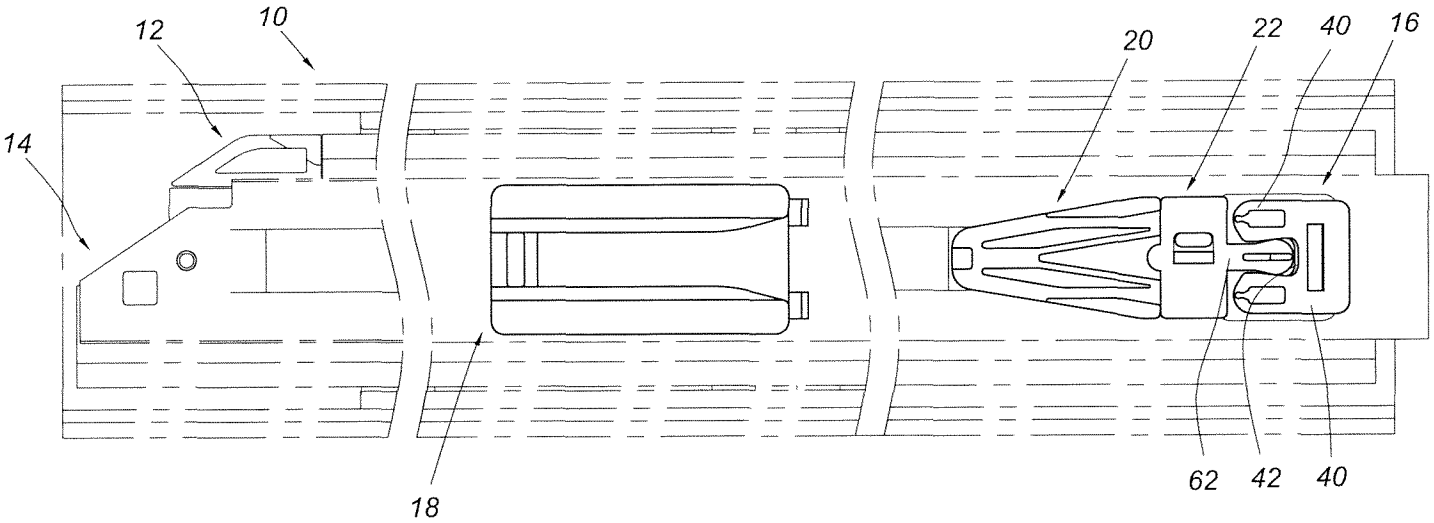
FIG. 6 is a schematic drawing in which the slide rail assembly in one embodiment of the present invention is in a retracted position, showing in particular the relationships between certain components in this position.

In FIG. 6, the slide rail assembly in one embodiment of the present invention is in a retracted state, in which the second contact member 22 is located between the first contact member 20 and the fixing base 16, and the projection 62 of the second contact member 22 is inserted in the clamping space 42 of the fixing base 16. With the arms 40 of the fixing base 16 clamping the projection 62 of the second contact member 22, the slide rail assembly is kept in the retracted state, and the third rail 14 is prevented from sliding outward even when tilted.

Figure 7:
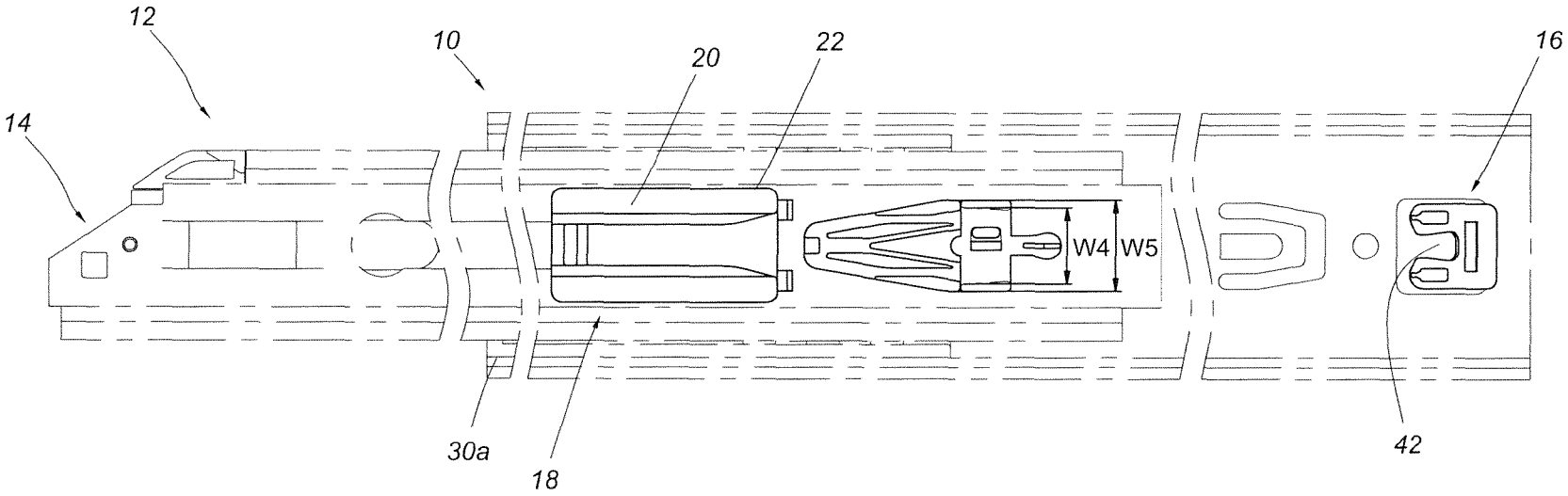
FIG. 7 is a schematic drawing showing how the second rail in one embodiment of the present invention is displaced simultaneously with the third rail.
Figure 8A:
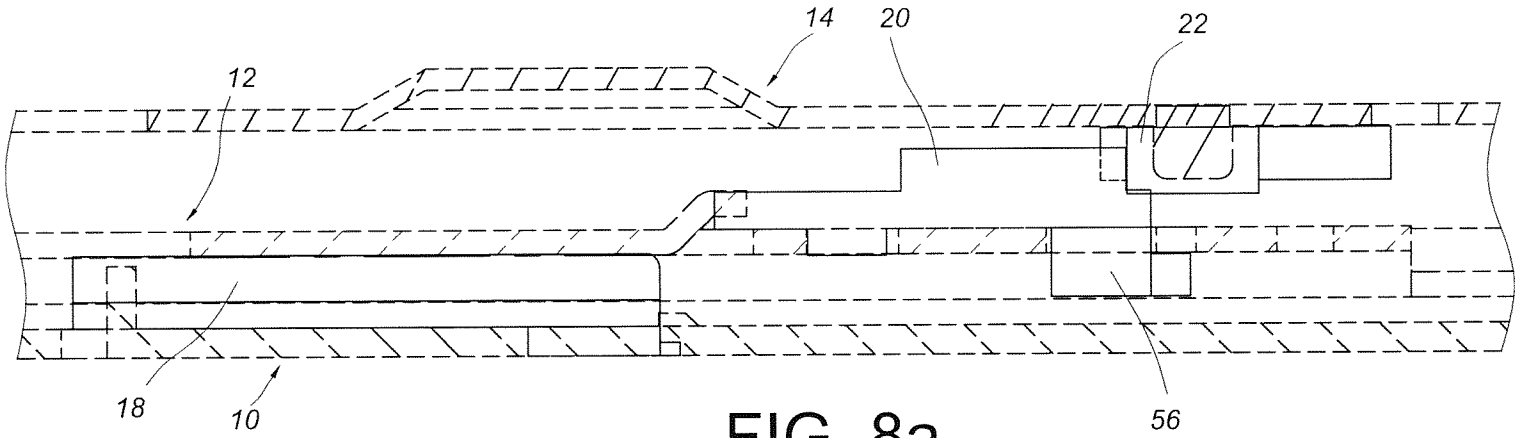
FIG. 8*a* is a schematic sectional view in which the second rail in one embodiment of the present invention has been displaced simultaneously with the third rail for a certain distance.

In FIG. 7 and FIG. 8*a*, the third rail 14 has been pulled out relative to the first rail 10. More specifically, a portion of the third rail 14 has been pulled out beyond the front end 30*a* of the first rail 10. In consequence, the second contact member 22 is released from the clamping space 42 of the fixing base 16. At the same time, the lateral portions 60 of the second contact member 22 are pressed against the first contact member 20 due to the fact that the fifth width W5 is slightly greater than the fourth width W4. Therefore, as the third rail 14 is pulled out, the second rail 12 is simultaneously displaced with the third rail 14.

Figure 8B:
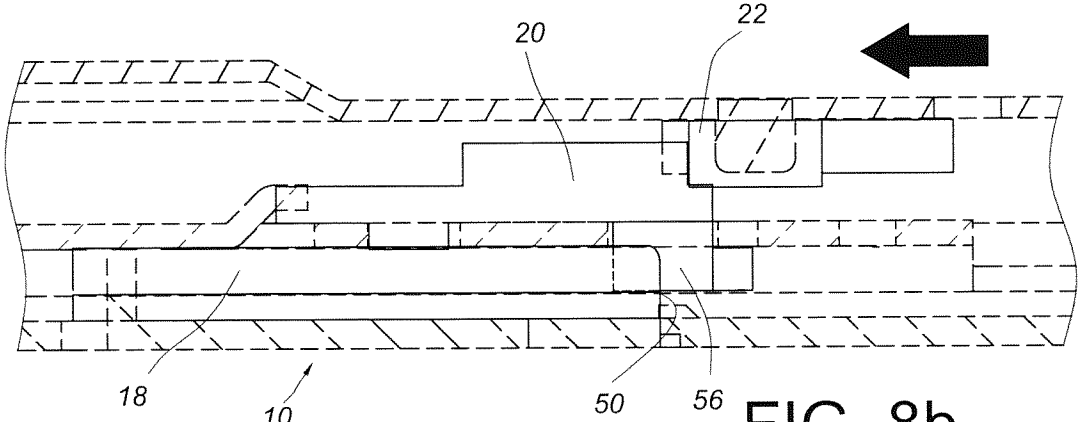
FIG. 8*b* is a schematic sectional view in which the second rail in one embodiment of the present invention has been displaced simultaneously with the third rail such that the second contact portions of the first contact member partially enter the guiding base.
Figure 9A:
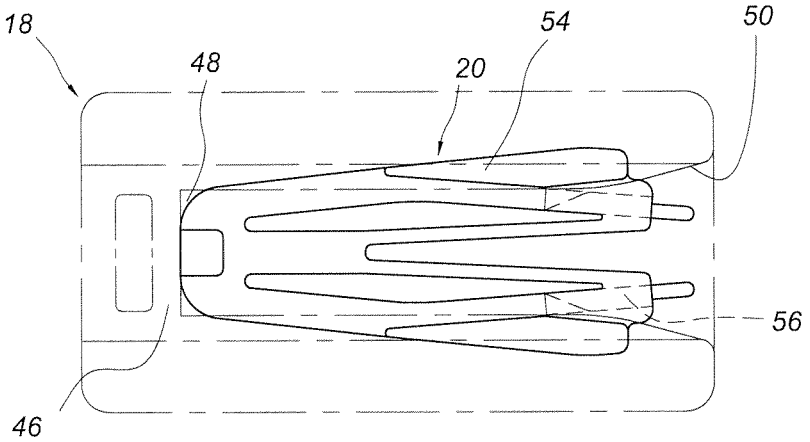
FIG. 9*a* is a schematic drawing in which the second contact portions of the first contact member in one embodiment of the present invention have entered the guiding base such that the first contact member is compressed by the guiding base.
Figure 9B:
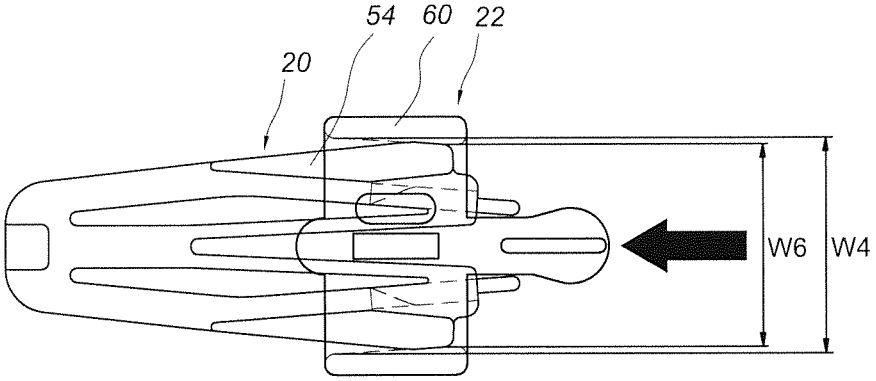
FIG. 9*b* schematically shows how the second contact member in one embodiment of the present invention moves past the first contact member.

In FIG. 8*b*, the first contact member 20, against which the second contact member 22 is pressed, has been displaced to the guiding base 18, with the second contact portions 56 of the first contact member 20 partially entering the guiding entrance 50 of the guiding base 18. As the third width W3 between the second contact portions 56 is greater than the first width W1 of the guiding path 48 of the guiding base 18 but less than the second width W2 at the guiding entrance 50 of the guiding base 18 (see FIG. 2 and FIG. 3), the first contact member 20, once pushed and displaced by the second contact member 22 to a predetermined position, enters the guiding path 48 of the guiding base 18 through the guiding entrance 50 of the guiding base 18, as shown in FIG. 9*a*. Meanwhile, the second contact portions 56 of the first contact member 20 are guided by the guiding path 48 of the guiding base 18 and compressed toward each other, and in consequence, the first contact portions 54 of the first contact member 20 are also compressed toward each other. In this compressed state as shown in FIG. 9*b*, the outer surfaces 55 of the first contact portions 54 of the first contact member 20 define a sixth width W6 therebetween, and the sixth width W6 is less than or at least equal to the fourth width W4.

Figure 9C:
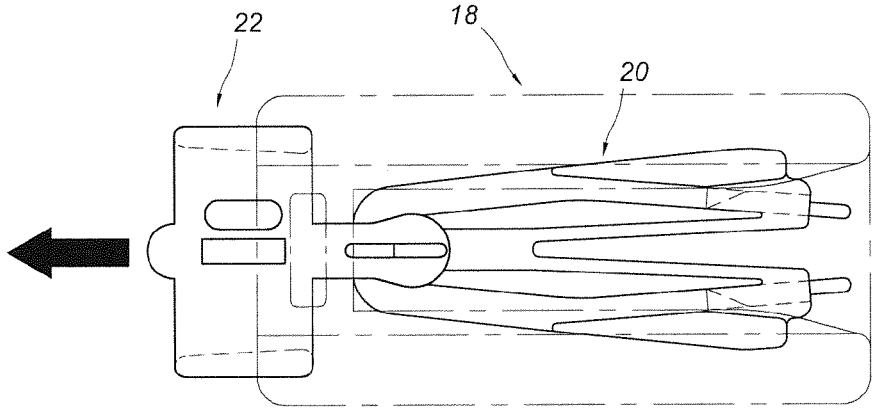
FIG. 9*c* is a schematic drawing in which the second contact member in one embodiment of the present invention has separated from the first contact member in a pulling direction.
Figure 9D:
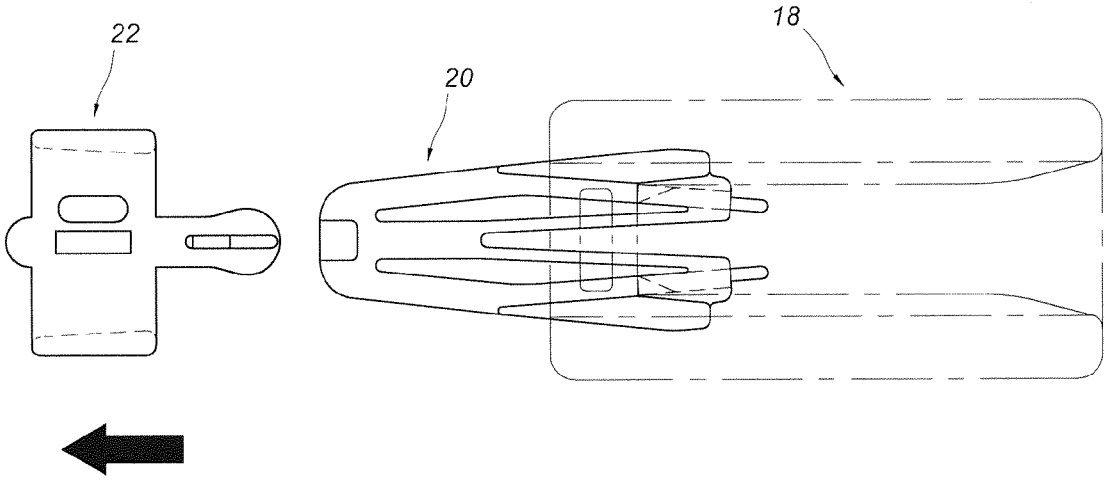
FIG. 9*d* is a schematic drawing in which the second contact portions of the first contact member in one embodiment of the present invention are pressed against the stop portion of the guiding base, thus bringing the second rail to its farthest extended position relative to the first rail.
Figure 10:
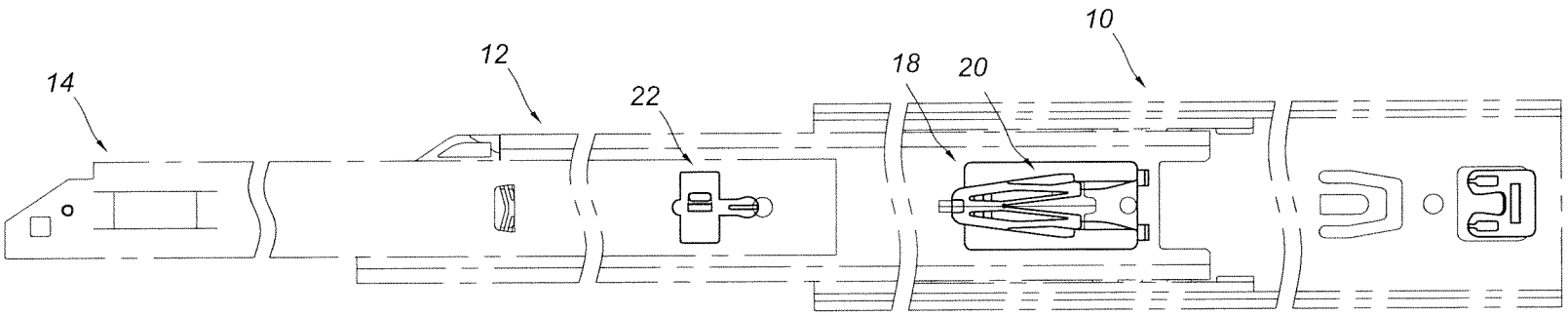
FIG. 10 schematically shows how the slide rail assembly in one embodiment of the present invention is extended.

The third rail 14 is continuously pulled out as shown in FIG. 9*c*, FIG. 9*d* and FIG. 10. Since the sixth width W6 is less than or at least equal to the fourth width W4, the second contact member 22 is able to move past the first contact member 20 and thus the lateral portions 60 of the second contact member 22 are no longer in contact with the first contact portions 54 of the first contact member 20. As a result, the second rail 12 ceases to be pulled along with the third rail 14 and stays at the guiding base 18, thanks to the first contact member 20. The second rail 12 stops as soon as it is extended to this position. The third rail 14 in this state, however, can be continuously pulled out relative to the second rail 12. Preferably, with continuously pulled out relative to the second rail 12, the third rail 14 is eventually brought into driving engagement with the second rail 12 in the same way as the conventional slide rails, driving the second rail 12 to move again. In this way, the second rail 12 reaches its farthest extended position relative to the first rail 10 when the second contact portions 56 of the first contact member 20 are pressed against the stop portion 46 of the guiding base 18.

Figure 11:
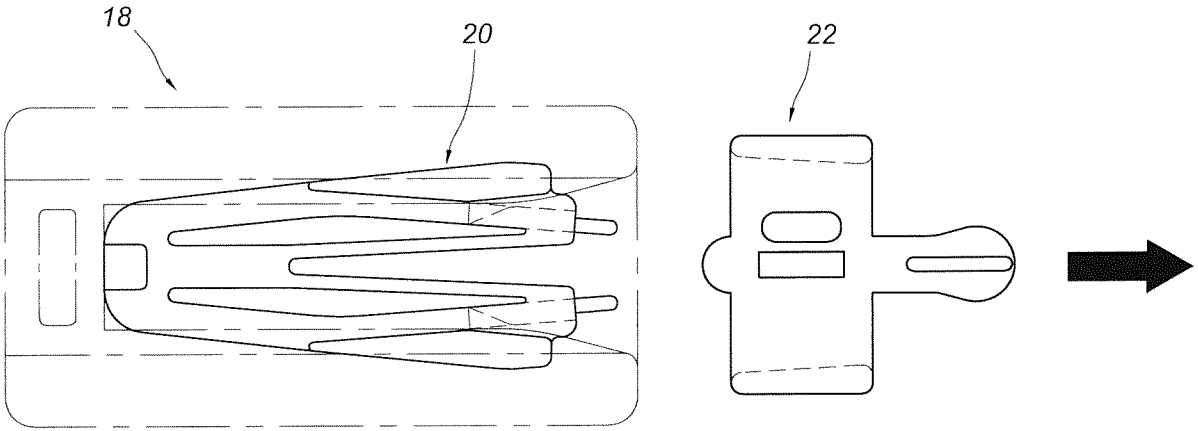
FIG. 11 is a schematic drawing in which the second contact member in one embodiment of the present invention has moved past the first contact member in a retracting direction.

The third rail 14 when retracted from an extended position relative to the first rail 10 is displaced relative to the second rail 12. The displacement of the third rail 14 relative to the second rail 12 will eventually cause the second contact member 22 to move past the first contact member 20, as shown in FIG. 11. Afterward, the third rail 14 will be brought into driving engagement with the second rail 12 in the same way as the conventional slide rails, allowing the second rail 12 to be pushed relative to the first rail 10, and the first contact member 20 will separate from the guiding base 18 in due course. Once the third rail 14 and the second rail 12 are fully retracted relative to the first rail 10, the slide rail assembly resumes the retracted state shown in FIG. 6.

While the present invention has been disclosed by way of the foregoing preferred embodiments, the embodiments are not intended to restrict the scope of the present invention. The scope of the present invention is defined only by the appended claims.

The invention claimed is:

1. A slide rail assembly comprising:

a first rail;

a second rail slidably connected to the first rail, the second rail having an opening;

a third rail slidably connected to the second rail;

a guiding base provided on the first rail to protrude therefrom toward the second rail, the guiding base having a pair of guiding portions and a stop portion defining a guiding path, the guiding path being closed at one longitudinal end by the stop portion and extending longitudinally to a guiding entrance in communication therewith;

a first contact member provided on the second rail, the first contact member being deflectable and having a pair of first contact portions extending between the second and third rails, and a pair of second contact portions connected to the first contact portions and passing through the opening of the second rail to extend between the second and first rails; and a second contact member provided on the third rail, the second contact member having at least one lateral portion extending between the second and third rails for engagement with one of the first contact portions of the first contact member;

wherein the guiding path of the guiding base defines a first width, the guiding entrance of the guiding base defines a second width, and the second contact portions of the first contact member define a third width therebetween, the third width being greater than the first width but less than the second width;

wherein when the third rail is longitudinally displaced from a retracted position relative to the second rail, the lateral portion of the second contact member engages a corresponding one of the first contact portions of the first contact member for displacement therewith; and wherein as the second and third rails displace together beyond a predetermined position relative to the first rail, the second contact portions of the first contact member are received in conformed manner through the guiding entrance into the guiding path of the guiding base to be longitudinally stopped therein, the first contact member being responsively deflected to displace the first contact portions toward each other and disengage from the lateral portion of the second contact member, the second contact member being thereby released to pass over the first contact member for displacement of the third rail relative to the second rail.

2. The slide rail assembly of claim 1, further comprising a fixing base fixed to the first rail, the fixing base having a pair of arms, the arms defining a clamping space therebetween, the second contact member having a projection corresponding to the clamping space, wherein when in the retracted position, the projection of the second contact member extends into the clamping space and is clamped by the arms of the fixing base.

3. The slide rail assembly of claim 1, wherein the second contact member has two lateral portions which correspond respectively to the first contact portions of the first contact member.

4. The slide rail assembly of claim 3, wherein the lateral portions of the second contact member each have an inner surface, the two inner surfaces facing each other and defining a fourth width therebetween, and the first contact portions of the first contact member each have an outer surface, the two outer surfaces facing away from each other and defining a fifth width therebetween, the fifth width being slightly greater than the fourth width.

5. The slide rail assembly of claim 1, wherein the first contact portions of the first contact member form a V shape.

* * * * *